United States Patent [19]

Duprez et al.

[11] 4,268,702

[45] May 19, 1981

[54] CATALYTIC CONVERSION OF AROMATIC FRACTIONS IN THE PRESENCE OF STEAM

[75] Inventors: Daniel Duprez, Poitiers; Michel Grand, Serezin du Rhone, both of France

[73] Assignee: Elf France, Paris, France

[21] Appl. No.: 52,359

[22] Filed: Jun. 27, 1979

[30] Foreign Application Priority Data

Jul. 7, 1978 [FR] France ..... 78 20265

[51] Int. Cl.[3] ..... C07C 12/02

[52] U.S. Cl. ..... 585/411; 208/137; 208/138; 208/141; 585/487

[58] Field of Search ..... 585/487, 411; 208/138, 208/141, 137

[56] References Cited

U.S. PATENT DOCUMENTS 3,829,519 8/1974 Sampson et al. ..... 585/487

FOREIGN PATENT DOCUMENTS 2262005 9/1972 Fed. Rep. of Germany ..... 585/487

198310 3/1971 U.S.S.R. ..... 585/487

*Primary Examiner*—Curtis R. Davis

*Attorney, Agent, or Firm*—Burgess, Ryan and Wayne

[57] ABSTRACT

A process for the catalytic conversion of aromatic fractions additionally containing variable proportions of $C_5$ to $C_{11}$ non-aromatic hydrocarbons, to obtain substantially pure benzene and hydrogen, by water dealkylation of the aromatic hydrocarbons and simultaneous reforming of the non-aromatic hydrocarbons, characterized in that aromatic fractions having boiling points which may be varied depending on the yield of hydrogen desired, are treated by steam at temperatures from 350° C. to 600° C., at a pressure of 1 to 80 bars, a volume of liquid passed per unit volume of catalyst of 0.1 to 10 and a water/hydrocarbon charge flow rate ratio of 0.2 to 4, in the presence of a dealkylation catalyst selected from at least one group VIII metal, on a support selected from a sieve L, a pretreated gamma alumina, and a mixed spinel $(M_xM'_{1-x})\ Al_2O_4$, M being a non-noble group VIII metal, and M' being selected from the group consisting of magnesium, manganese, and copper.

6 Claims, No Drawings

CATALYTIC CONVERSION OF AROMATIC FRACTIONS IN THE PRESENCE OF STEAM

The object of the present invention is a catalytic process for the steam treatment of charges containing mono- or polyalkylated aromatics admixed with a more or less high proportion of non-aromatic compounds such as paraffins, isoparaffins, and naphthenes. In the following this type of fraction will be designated by the term "aromatic fractions". They have a final distillation point less than 350° C., preferably less than 250° C.

The process of the present invention is applicable to all charges having the aforementioned characteristics, notably:

the liquid effluents from catalytic reforming, which are designated generically as "reformates", the liquid effluents from steam cracking.

The reformates and the effluents from steam cranking find essentially two applications in the petrol and petrochemical industry: firstly as a base for automobile fuel and in this case, they are incorporated whole in the "pool" fuel, secondly, as a source of major aromatic compounds (benzene, toluene, xylenes) for the chemical industry, and in this case it is necessary to extract these compounds. Because of the proximity of the boiling points of the aromatics and a large number of the non-aromatic compounds present in the "aromatic fractions", a simple distillation, even a very careful one, cannot suffice. There is then employed an operation known as an extractive distillation much more complex and costly than simple distillation and which raises the cost of the aromatics thus obtained.

After extraction and separation, these aromatics are sent to a dealkylation unit to produce benzene so as to balance the supply and demand market of the various aromatics.

Following the Haensel patent filed for U.O.P. in 1948 (U.S. Pat. No. 2,436,923) numerous procedures have been proposed, permitting the dealkylation of mono or polyalkylated aromatics, in the presence of steam. The applicant has protected several catalyst systems offering good activity and good selectivity allied to excellent stability; these catalysts, containing one or several group VIII metals—notably rhodium - deposited on supports based on sieve L (French Patent application No. 77-38.277), pretreated gamma alumina (French Patent applicatiion No. 78-6424) or mixed spinel $(M_xM'_{1-x})$ $Al_2O_4$ (French Patent application no. 77-7987), M being a non-noble group VIII metal and M' being selected from the group of magnesium, manganese, and/or copper.

Mitsubishi in French Pat. No. 72-46612 of 28.12.72 described a process for the preparation of dealkylated aromatic hydrocarbons and hydrogen, by the catalytic steam dealkylation of a hydrocarbon oil containing at least 50% of paraffins and naphthenes in the presence of catalysts based on nickel, or based on thorium, or based on rhodium and uranium.

The present invention concerns a process utilising the water dealkylation catalysts for aromatics, applied to the "aromatic fractions". In effect, these catalysts, active for dealkylation, have been found also to be very active and of remarkable stability for the steam reforming of paraffins, isoparaffins, and naphthenes, and favour a secondary reaction: the dehydrocyclisation of paraffins which raises the concentration of aromatics in the fraction.

In accordance with the invention and according to a first method of putting it into practice, the catalytic conversion is carried out by contacting the aromatic fraction with one of the aforementioned catalysts in the presence of steam at a temperature from 350° to 600° C., preferably 375° to 550° C., under a total pressure of 1 to 80 bars, preferably 1 to 60 bars, a v.v.h (volume of liquid passed per unit volume of catalyst per hour) in relation to the hydrocarbon charge from 0.1 to 10 and preferably from 0.3 to 5, a ratio of liquid output of water to hydrocarbon charge from 0.2 to 4, and preferably from 0.4 to 2.5.

Under these conditions the aromatics in the charge are essentially dealkylated into benzene and the non-aromatics are transformed to gaseous compounds (gaseous hydrocarbons, carbon dioxide, hydrogen). The paraffins, isoparaffins, and naphthenes which are the most reactive in steam reforming are the lightest, notably the $C_5$ and $C_6$ paraffins, therefore those of which the boiling point is close to that of benzene.

As a result of the steam treatment, the aromatic fraction is considerably enriched in benzene, which can be isolated by simple distillation since the hydrocarbons having neighbouring boiling points have been transformed.

This method of operation No. 1 is directly applicable to the aromatic fractions, it has however two disadvantages:

it necessitates relatively severe reaction conditions of temperature to be able to transform by steam reforming substantially all the $C_6$ paraffins in order to obtain a very pure benzene fraction by simple distillation, if the light $C_5$ and $C_6$ aromatics are abundant of the order of 10% by weight for a reformate) the process becomes quite exothermic and produce a considerable quantity of gas.

A preferred form of the invention consists in modifying the charge in the following manner: the aromatic fraction is distilled at the level of benzene and there is used as charge the fraction of boiling point greater 75°-77° C. at 760 mm of mercury (generically designated as 75+ ). There are thus eliminated substantially all the $C_5$ and $C_6$ aromatics present. It is this modified charge that is passed into the reactor with the steam under the aforementioned conditions.

This method of operation No. 2 derived from method of operation No. 1 applied to modified aromatic fractions known as 75+ has the following advantages:

the new charge is richer in aromatics: the dealkylation which competes at the level of the catalytic action with the steam reforming reactions becomes move favoured.

the quantity of paraffins to be reformed is reduced (by about 30% in the case of a reformate). The exothermicity of the reaction is moderated by virtue of a reduced production of gas, notably $CH_4$, and compensated by the endothermicity of the dealkylation.

Another preferred form of the invention consists in distilling the aromatic fraction at the level of toluene (instead of benzene in the present case). This time there are eliminated substantially all the $C_5$ to $C_7$ paraffins. In the case of a reformate, this fraction represents about 60% of the non-aromatics. It is preferred to conserve substantially all the toluene in the fraction 105+. The initial benzene is excluded from the new charge, but the fraction 105− can be recycled to fuel stocks, which contributes to the improvement of the octane index in the light fuel fraction. On the other hand, in method of operation No. 3, the steam conversion of the aromatic fractions has incontestable advantages:

the benzene formed by dealkylation is substantially the only light produced in the liquid obtained after treatment, that is to say to the fraction 100− practically consists only of benzene.

as it is not longer necessary to reform the $C_5$ to $C_7$ paraffins, isoparaffins, and naphthenes as there are none of them in the charge, it is possible to operate at a medium severity (420°–450° C.), the only criterion then being the yield of benzene.

One advantage of the process, whether it be in the form 1, 2 or 3, is the production of a gas rich in hydrogen, about two-thirds of which is produced by the water itself.

This result is general whether by the dealkylation reactions or by the steam reforming, nevertheless the yield of gas is greater for the steam reforming because the whole molecule is gasified. In the steam conversion process, one can therefore modulate the production of gas and notably of hydrogen by modifying the content of non-aromatics in the charge: to a reformate fraction at 105+ there can be added a small proportion (less than 30% and preferably less than 15%) of $C_5$ and $C_6$ paraffins. These are reformed to produce hydrogen but in no way interfere with the distillation of benzene.

In order to illustrate the invention, and in a non-limiting way, are given the following examples relating to the steam conversion of reformates:

EXAMPLE 1

A reformate (charge I) having an octane index of 97.8 has the following composition (in weight %).

Principal non-aromatics $C_5$ (i−$C_5$+n $C_5$)=5.69
$C_6$ (2−Me $C_5$+3−Me $C_5$+n $C_6$)=4.91
$C_7$ (2−Me $C_6$+3−Me $C_6$+n $C_7$)=7.64
$C_8$ (2−Me $C_7$+3−Me $C_7$+n $C_8$)=4.63 these paraffins and isoparaffins represent about 75% of the total $C_5$ to $C_8$ non-aromatics.

Aromatics

| | | |
|---|---|---|
| Benzene | = | 1.91 |
| Toluene | = | 13.98 |
| $C_8$ (ethyl benzene + xylene) | = | 24.12 |
| $C_9$ (propylbenzene + methylethylbenzene + trimethylbenzene) | = | 18.62 |

10 g of a catalyst of 0.6% by weight of rhodium deposited on a mixed spinel $Ni_{0.75}Mg_{0.25}Al_2O_4$, prepared in accordance with French Patent application No. 78-07987 are charged into a fixed bed continuous flow reactor. It is reduced for 10 hours under a current of 25 l/h of hydrogen at a temperature rising from ambient to 450° C. at a rate of 1° C. $mm^{-1}$. After having cut off the hydrogen, water is passed at a temperature of 450° C., at the rate of 12.5 $g^{h-1}$ of liquid water, for ½ hour. The charge (reformate I) is then passed at the same time as the water at the rate of 10 $g^{h-1}$. The v.v.h of the hydrocarbon charge is 1.3 (density of catalyst be: 1.05 g $cm^{-3}$, density of reformate: 0.802 g $cm^{-3}$).

The total pressure is maintained at 2 bars. The results are reported in Table 1, in the products, the noted $C_5$ to $C_8$ paraffins are the principle paraffins, so as to be directly comparable with the starting charge.

TABLE 1

| Temperature °C. | Operating time (h) | Yields in g for 100 g of charge passed $H_2$ | CO | $CO_2$ | $CH_4$ | $C_2$–$C_4$ | $C_5$ | $C_6$ | $C_7$ | $C_8$ | B | T | Aro. $C_8$ | Aro. $C_9$ |
|---|---|---|---|---|---|---|---|---|---|---|---|---|---|---|
| 451° C. | 6 h | 5.3 | 2.4 | 51.6 | 13.5 | x | 1.00 | 1.61 | 3.03 | 1.79 | 13.6 | 18.2 | 14.3 | 6.0 |
| 451° C. | 26 h | 4.8 | 1.7 | 49.4 | 9.5 | x | 1.19 | 1.93 | 3.63 | 2.16 | 11.9 | 17.2 | 15.5 | 7.9 |
| 471° C. | 50 h | 5.5 | 3.7 | 52.5 | 17.0 | 6.2 | 1.09 | 1.19 | 2.41 | 1.46 | 18.6 | 15.7 | 10.5 | 4.6 |
| 500° C. | 54 h | 6.8 | 8.4 | 69.4 | 31.9 | 12.9 | 1.20 | 1.00 | 1.70 | 1.12 | 22.4 | 13.7 | 7.5 | 2.9 |
| 500° C. | 73 h | 6.9 | 8.1 | 70.4 | 25.0 | 13.6 | 1.30 | 0.95 | 1.90 | 1.33 | 23.9 | 14.3 | 8.6 | 3.6 |
| 521° C. | 78 h | 8.1 | 14.9 | 84.0 | 38.6 | 15.0 | 1.64 | 0.94 | 1.00 | 0.80 | 29.2 | 12.3 | 5.5 | 1.9 |
| 521° C. | 97 h | 7.5 | 12.0 | 75.0 | 29.5 | 17.1 | 1.29 | 0.98 | 2.07 | 1.52 | 26.0 | 13.9 | 8.4 | 3.0 |

Table 1: Results of test of catalytic conversion using steam of a reformate Catalyst: 0.6% Rh on spinel $Ni_{0.75}Mg_{0.25}Al_2O_4$
vvh = 1.3
volumatic flow rate of water and hydrocarbons: 12.5 $cm^3H^{-1}$
Pressure: 2 bars
B = Benzene
T = Toluene
$C_8$ aromatics = Aro $C_8$
$C_9$ aromatics = Aro $C_9$
$C_5$, $C_6$, $C_7$, $C_8$ paraffins } of $C_5$ to $C_8$
iso-paraffins

EXAMPLE 2

A reformate of octane index 97.8 (reformate II) is submitted to a distillation so as to retain the fraction 105+(°C.). The starting reformate and the two fractions are analysed; there are determined the yields by weight of each of the fractions by distillation.

There is thus obtained the distribution of the principle products in each of the two fractions (Table 2).

The catalyst of Example 1 is tested under the same pretreatment conditions. The pressure is 6 bars, the starting temperature of the test: 438° C. The charge is, this time, the fraction of reformate II cut at 105+.

The results are reported in Table 3. From 438° C., there is formed a large quantity of benzene (more than 20 g per 100 g of charge passed). There are also obtained very small quantities of $C_6$ and $C_7$ non-aromatics, of which a large proportion can be eliminated by distillation of the benzene fraction. The purity of this latter by simple distillation (without preliminary extraction) can thus attain the specification generally required of 99.8% minimum.

EXAMPLE 3

The catalyst of Example 1 is tested under the conditions of Example 2, at 30 bars (instead of 6). The results are reported in Table 3. The yield of hydrogen is reduced to the benefit of the yield of methane. The yield of benzene is substantially the same as at 6 bars; it is moreover much more stable.

TABLE 2

| | PRINCIPAL PARAFFINS** | | | | AROMATICS | | | |
|---|---|---|---|---|---|---|---|---|
| | $C_5$ | $C_6$ | $C_7$ | $C_8$ | B | T | $C_8$ | $C_9$ |
| 100g starting charge | 6.81 | 5.62 | 6.79 | 3.49 | 2.37 | 15.28 | 25.22 | 18.37 |
| *72.6 g charge cut at 105+ | 0 | 0 | 0.35 | 3.35 | 0 | 13.48 | 25.20 | 18.34 |
| *23.7 g charge cut at 105− | 5.21 | 4.84 | 6.07 | 0.12 | 2.27 | 1.59 | 0.02 | 0 |
| Analysis 100g charge 105+ | 0 | 0 | 0.48 | 4.62 | 0 | 18.53 | 34.72 | 25.26 |

Table 2:
composition of reformate II and of fractions 105 and 105
*3.7 g lost in the distillation (essentially light hydrocarbons, $C_5$ and $C_6$)
**the principal paraffins (normal and iso-paraffins) are those which have been observed in the composition of reformate I (see Example 1)

TABLE 3

| Pressure | Temperature | Operating time (h) | $H_2$ | CO | $CO_2$ | $CH_4$ | $C_2$–$C_4$ | $C_5$ | $C_6$ | $C_7$ | $C_8$ | B | T | Aro. $C_8$ | Aro. $C_9$ |
|---|---|---|---|---|---|---|---|---|---|---|---|---|---|---|---|
| | | | Yields in g per 100 g of charge passed | | | | | | | | | | | | |
| 6bars | 438° C. | 2 h | 2.10 | 0.60 | 22.30 | 9.70 | 0.05 | 0.14 | 0.12 | 0.28 | 0.85 | 21.8 | 27.1 | 17.4 | 5.2 |
| 6bars | 438° C. | 6 h | 1.91 | 0.56 | 21.8 | 9.10 | 0.05 | 0.13 | 0.12 | 0.29 | 0.88 | 20.6 | 27.2 | 17.9 | 6.5 |
| 6bars | 450° C. | 25 h | 2.78 | 1.1 | 29.4 | 13.2 | 0.11 | 0.24 | 0.18 | 0.20 | 0.67 | 27.6 | 24.5 | 16.2 | 2.1 |
| 6bars | 450° C. | 48 h | 2.59 | 1.0 | 28.5 | 12.2 | 0.10 | 0.23 | 0.17 | 0.22 | 0.72 | 26.3 | 24.7 | 16.4 | 2.9 |
| 30bars | 441° C. | 4 h | 1.55 | 0.19 | 19.8 | 13.4 | 0.08 | 0.15 | 0.11 | 0.31 | 0.94 | 20.1 | 26.4 | 18.2 | 7.4 |
| 30bars | 440° C. | 25 h | 1.43 | 0.17 | 19.0 | 12.9 | 0.09 | 0.16 | 0.12 | 0.32 | 0.99 | 20.2 | 26.8 | 18.8 | 7.8 |
| 30bars | 453° C. | 46 h | 1.58 | 0.16 | 22.9 | 15.8 | 0.13 | 0.22 | 0.14 | 0.24 | 0.78 | 27.4 | 23.9 | 15.8 | 4.9 |
| 30bars | 453° C. | 73 h | 1.56 | 0.16 | 23.0 | 15.6 | 0.14 | 0.21 | 0.13 | 0.25 | 0.81 | 27.3 | 24.0 | 16.0 | 5.3 |

Table 3:
Catalytic conversion with steam of a reformate cut at 105
Catalyst: 0.6% on mixed spinel $Ni_{0.75}Mg_{0.25}Al_2O_4$
v.v.h. = 1.3 *with reference to the hydrocarbon charge*
volumatic flow rate of water and hydrocarbons: 12.5 $cm^3H^{-1}$

What is claimed is:

1. A process for the catalytic conversion of aromatic fractions containing variable proportions of $C_5$ to $C_{11}$ non-aromatic hydrocarbons, to obtain benzene and hydrogen, by water dealkylation of the aromatic hydrocarbons and simultaneous reforming of the non-aromatic hydrocarbons, which comprises: contacting an aromatic fraction with steam at a temperature of from 350° C. to 600° C., at a pressure of 1 to 80 bars and a water to hydrocarbon charge ratio by liquid volume of 0.2 to 4, in the presence of a dealkylation catalyst consisting essentially of rhodium on a mixed spinel $(M_xM'_{1-x})Al_2O_4$, support M being a non-noble group VIII metal, and M' being selected from the group consisting of magnesium, manganese, and copper at a rate of 0.1 to 10 liquid volumes of aromatic fraction per volume of catalyst per hour.

2. A process according to claim 1 characterised in that the aromatic $C_5$ to $C_{11}$ fraction is considerably enriched in benzene by dealkylation at a temperature from 350° C. to 550° C., and the benzene is recovered by distillation.

3. A process according to claim 1, characterised in that the aromatic fraction comprises an aromatic fraction having a boiling point above 75° C. and the dealkylation is effected at a temperature of 400° C. to 500° C.

4. A process according to claim 1 characterised in that the aromatic fraction comprises an aromatic fraction having a boiling point above 105° C.

5. A process according to claim 1, characterised in that the production of hydrogen is increased by addition to the aromatic fraction of 5 to 30% by weight of light paraffins containing not more than 5 carbon atoms.

6. A process according to claim 1, characterised in that the dealkylation catalyst is a mixed spinel $Ni_{0.75}Mg_{0.25}Al_2O_4$ on which is deposited 0.6% of rhodium.

* * * * *